US011054186B2

(12) United States Patent
Yoshimura et al.

(10) Patent No.: US 11,054,186 B2
(45) Date of Patent: Jul. 6, 2021

(54) HEAT EXCHANGER

(71) Applicant: Mitsubishi Electric Corporation, Chiyoda-ku (JP)

(72) Inventors: Susumu Yoshimura, Chiyoda-ku (JP); Yasuhiro Yoshida, Chiyoda-ku (JP); Kazuhiro Miya, Chiyoda-ku (JP); Kosuke Miyawaki, Chiyoda-ku (JP); Norihiro Yoneda, Chiyoda-ku (JP); Takahiro Hori, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 200 days.

(21) Appl. No.: 16/082,497

(22) PCT Filed: Mar. 24, 2017

(86) PCT No.: PCT/JP2017/012036
§ 371 (c)(1),
(2) Date: Sep. 5, 2018

(87) PCT Pub. No.: WO2017/179399
PCT Pub. Date: Oct. 19, 2017

(65) Prior Publication Data

US 2019/0086153 A1 Mar. 21, 2019

(30) Foreign Application Priority Data

Apr. 15, 2016 (JP) ..... JP2016-081696

(51) Int. Cl.
*F28D 1/04* (2006.01)
*F28F 19/04* (2006.01)
(Continued)

(52) U.S. Cl.
CPC ..... *F28D 1/04* (2013.01); *F28F 1/28* (2013.01); *F28F 1/32* (2013.01); *F28F 19/04* (2013.01); *F28F 19/06* (2013.01)

(58) Field of Classification Search
CPC ..... F28D 1/04; F28F 1/28; F28F 1/32; F28F 19/04; F28F 19/06
(Continued)

(56) References Cited

U.S. PATENT DOCUMENTS 1,870,012 A * 8/1932 Karmazin ..... F28F 1/28 165/151
1,940,804 A * 12/1933 Karmaxin ..... F28F 1/28 165/151
(Continued)

FOREIGN PATENT DOCUMENTS

DE 32 42 260 A1 5/1984
DE 3242260 A1 * 5/1984 ..... F28F 1/28
(Continued)

OTHER PUBLICATIONS

DE3242260A1 Machine Translation (Year: 1984).*
(Continued)

*Primary Examiner* — Len Tran
*Assistant Examiner* — Gustavo A Hincapie Serna
(74) *Attorney, Agent, or Firm* — Xsensus LLP

(57) ABSTRACT

Provided is a heat exchanger capable of ensuring both heat exchange performance and reliability against corrosion. The heat exchanger includes a plurality of fins each having a flat plate shape, openings provided in each of the plurality of fins, and cylindrical parts arranged on outer peripheries of the openings, each having an inner diameter larger than an outer diameter of each of the openings. The plurality of fins are stacked on one another with the cylindrical parts interposed between the plurality of fins. The openings and the
(Continued)

cylindrical parts are configured to form a liquid passage pipe, and the openings protrude further inside than are the cylindrical parts.

7 Claims, 11 Drawing Sheets

(51) Int. Cl.
*F28F 19/06* (2006.01)
*F28F 1/28* (2006.01)
*F28F 1/32* (2006.01)

(58) Field of Classification Search
USPC ..... 165/152, 151, 153, 182
See application file for complete search history.

(56) References Cited

U.S. PATENT DOCUMENTS 2,804,286 A * 8/1957 Pintarelli ..... F24H 1/145 165/182
3,250,323 A * 5/1966 Karmazin ..... F28F 9/26 165/150
4,340,114 A * 7/1982 Levy ..... F25B 39/00 165/110
4,789,027 A * 12/1988 Diethelm ..... F28B 1/06 165/124
5,318,112 A * 6/1994 Gopin ..... F28D 1/05366 165/151
6,209,201 B1 * 4/2001 Yamada ..... F28F 1/32 29/890.045
6,266,882 B1 * 7/2001 Ali ..... F28F 1/24 29/890.046
2007/0023177 A1 * 2/2007 Lee ..... F28F 1/32 165/182
2010/0018691 A1 * 1/2010 Ohgami ..... F28F 1/325 165/185
2010/0089557 A1 * 4/2010 Kim ..... F28F 17/005 165/151
2011/0067849 A1 * 3/2011 Fujino ..... F28F 1/325 165/182
2011/0203782 A1 * 8/2011 Schaefer ..... F28F 1/30 165/181
2012/0125030 A1 * 5/2012 Kim ..... F25B 39/00 62/238.6
2015/0054065 A1 * 2/2015 Chuang ..... H01L 29/66977 257/329
2015/0068714 A1 * 3/2015 Garosshen ..... F28F 19/06 165/134.1
2017/0114932 A1 * 4/2017 Nakajima ..... B23K 1/19
2017/0248370 A1 * 8/2017 Nakamura ..... F28D 1/053

FOREIGN PATENT DOCUMENTS

FR 2191087 A1 * 2/1974 ..... F28F 1/28
GB 2 129 538 A 5/1984
JP 49-135841 U 11/1974
JP 52-30955 A 3/1977
JP 54-7659 A 1/1979
JP 54-63554 U 5/1979
JP 55053698 A * 4/1980
JP 56-121995 A 9/1981
JP 56121995 A * 9/1981
JP 56-168086 A 12/1981
JP 58-6394 A 1/1983
JP 58-127092 A 7/1983
JP 61-15359 B2 4/1986
JP 63-97077 U 6/1988
JP 09119792 A * 5/1997
JP 2000-138331 A 5/2000
JP 2003329385 A * 11/2003 ..... F28F 1/32
JP 2008-89230 A 4/2008
JP 2010-96413 A 4/2010
JP 2011-021824 A 2/2011
WO WO-2012117440 A1 * 9/2012 ..... F28F 1/42
WO WO-2014167827 A1 * 10/2014 ..... F28F 1/10
WO 2015/015466 A1 2/2015

OTHER PUBLICATIONS

Machine Translation DE3242260A1 (Year: 1984).*
Office Action dated May 4, 2020 in German Patent Application No. 11 2017 002 007.7, 16 pages.
International Search Report dated Jun. 13, 2017, in PCT/JP2017/012036, filed Mar. 24, 2017.

* cited by examiner

HEAT EXCHANGER

TECHNICAL FIELD

The present invention relates to a heat exchanger, and more particularly, to a heat exchanger of a plate-fin type used for an air-conditioning apparatus.

BACKGROUND ART

A related-art heat exchanger includes, for example, as in Patent Literature 1, a plurality of fins each having a flat plate shape and including a plurality of fin collars, and the plurality of fins are stacked on one another so that hole centers of the plurality of fin collars each having a cylindrical shape coincide with each other. The fin collars continuously provided are joined to one another by resin and are sealed. In this manner, a plurality of liquid passage pipes and a fin core are formed. A surface of each of the liquid passage pipes is protected from corrosion by a resin film formed on an inner peripheral surface of each of the liquid passage pipes.

CITATION LIST

Patent Literature

Patent Literature 1: Japanese Examined Patent Application Publication No. 61-015359

SUMMARY OF INVENTION

Technical Problem

In the heat exchanger described in Patent Literature 1, a thickness of the resin film formed on the inner peripheral surface of the liquid passage pipe is small, and hence defects such as flaws and pin holes that may be caused on the resin film, or separation that may be caused due to aging degradation of the resin film itself easily occurs. When the defects or the separation of the resin film occurs, corrosion propagates to the fin, with the result that the heat exchange performance is degraded. Further, the resin film having a small thickness does not have enough strength. Thus, there is a problem in that the resin film may be broken due to bending, torsion, or shear to be applied to the joining portion when the heat exchanger is installed in a casing or is conveyed. When the resin film is increased in thickness to enhance the anticorrosive performance, there arises another problem in that the resin film may act as a thermal resistance to degrade the heat exchange performance. Further, a fluid having relatively high viscosity such as water and an antifreeze solution is caused to flow through the liquid passage pipe in many cases, and when the liquid passage pipe is formed to have a small diameter to attain high heat transfer performance, there is a problem in that the flow through the liquid passage pipe may be laminarized to degrade the heat exchange performance.

The present invention has been made to solve the problems described above, and has an object to provide a heat exchanger capable of ensuring both heat exchange performance and reliability against corrosion, and further, to provide a heat exchanger capable of achieving high heat exchange performance even when a flow through a liquid passage pipe is laminarized.

Solution to Problem

A heat exchanger according to an embodiment of the present invention includes a plurality of fins each having a flat plate shape, openings provided in each of the plurality of fins, and cylindrical parts arranged on outer peripheries of the openings, each having an inner diameter larger than an outer diameter of each of the openings. The plurality of fins are stacked on one another with the cylindrical parts interposed between the plurality of fins. The openings and the cylindrical parts are configured to form a liquid passage pipe, and the openings protrude further inside than are the cylindrical parts.

Advantageous Effects of Invention

In the heat exchanger according to an embodiment of the present invention, the fins protruding further inside than are the cylindrical parts come into direct contact with a heat medium, thereby the heat exchange efficiency can be enhanced. Further, the cylindrical parts are provided on the outer peripheries of the openings of the fins, and the fins are stacked on one another. Unlike the related art, the strength can be enhanced without increasing a resin film in thickness. Further, even when corrosion occurs, the corrosion hardly occurs in the surface direction of the fins, and hence degradation in sealing performance is prevented.

DESCRIPTION OF EMBODIMENTS

Embodiment 1

<Configuration of Heat Exchanger 10>

Figure 1:
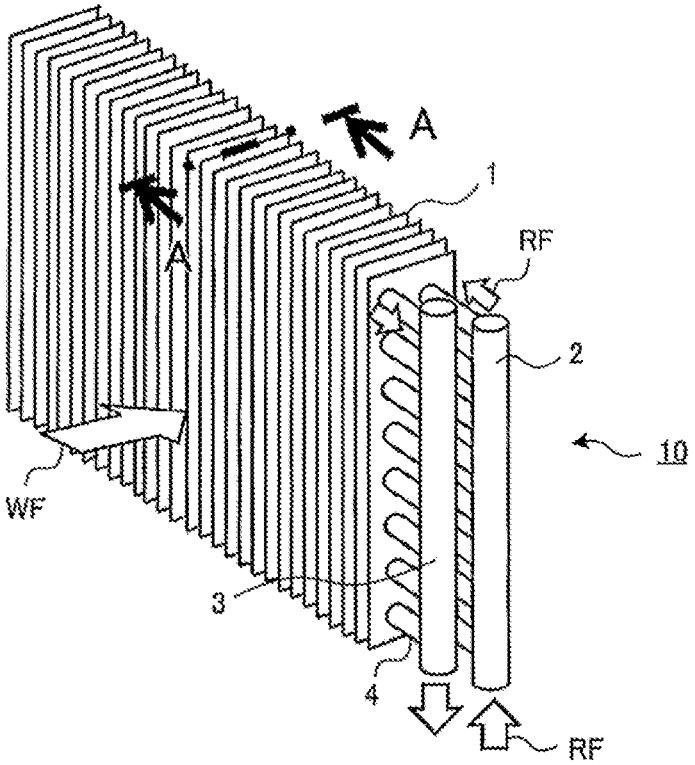
FIG. 1 is a perspective view for illustrating an outer appearance of a heat exchanger according to Embodiment 1.
Figure 2:
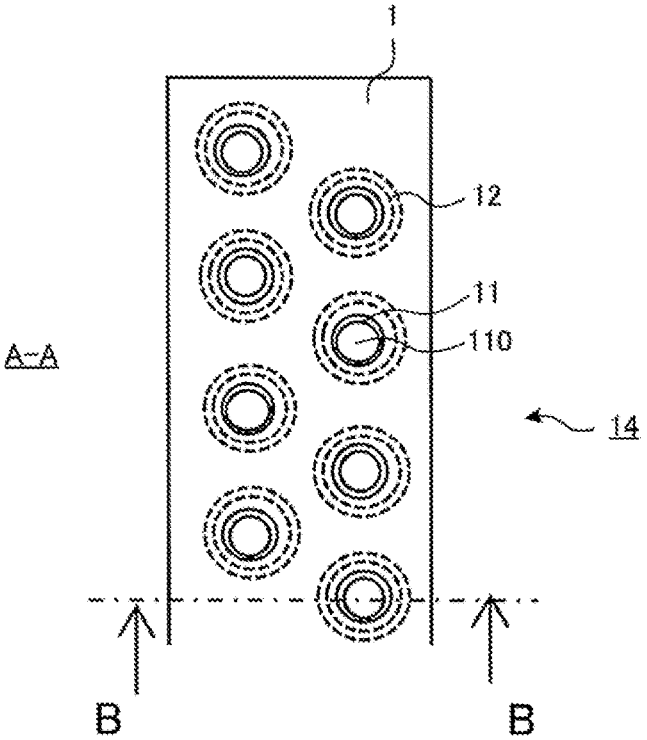
FIG. 2 is a schematic view for illustrating a fin of the heat exchanger according to Embodiment 1 as viewed in the direction A-A of FIG. 1.
Figure 3:
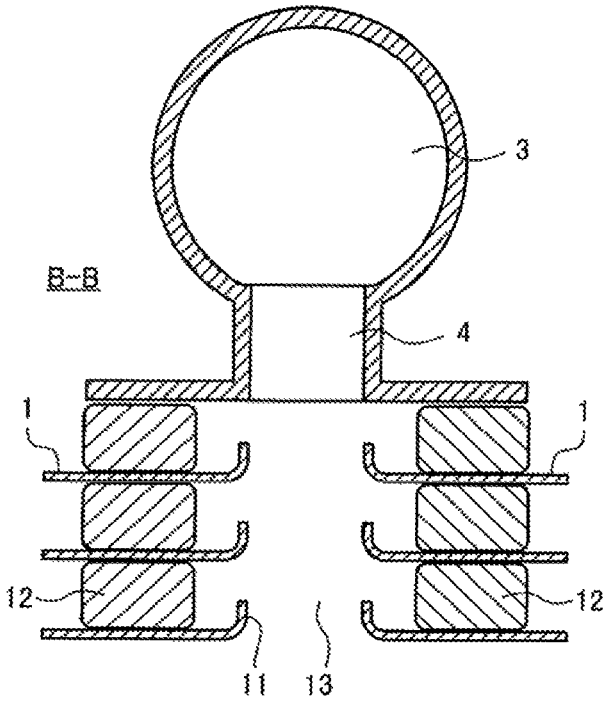
FIG. 3 is a schematic view for illustrating the heat exchanger according to Embodiment 1 as viewed in the direction B-B of FIG. 2.

FIG. 1 is a perspective view for illustrating an outer appearance of a heat exchanger 10 according to Embodiment 1. In FIG. 1, a flow direction of air WF and a flow direction of water RF serving as a heat transfer medium are indicated by the arrows. FIG. 2 is a schematic view for illustrating a fin 1 of the heat exchanger 10 according to Embodiment 1 as viewed in the direction A-A of FIG. 1. FIG. 3 is a schematic view for illustrating the heat exchanger 10 according to Embodiment 1 as viewed in the direction B-B of FIG. 2. In FIG. 3, a configuration close to an upstream of the flow of the air WF is illustrated. A configuration close to a downstream of the flow of the air WF is the same, and thus, illustration of the configuration close to the downstream is omitted.

As illustrated in FIG. 1 to FIG. 3, the heat exchanger 10 according to Embodiment 1 includes a plurality of stacked fins 1, fin collars 11, and resin parts 12.

Each of the plurality of fins 1 is a part having a flat plate shape and being made of metal such as aluminum, and the plurality of fins 1 are stacked in a direction orthogonal to the flow direction of the air. That is, the plurality of fins 1 are arrayed at intervals. The plurality of fin collars 11 are formed on one surface of each of the fins 1. The plurality of fin collars 11 protrude in the stacking direction from a plurality of openings 110 provided in each of the fins 1. The plurality of fins 1 are stacked on one another with the resin parts 12 interposed between the plurality of fins 1 while centers of the plurality of fin collars 11 coincide with each other. The stacked fin collars 11 and resin parts 12 form a liquid passage pipe 13 in the stacking direction of the plurality of fins 1. The resin part 12 is one example of a cylindrical part of the present invention. In the following description, a surface of the fin 1 from which the fin collar 11 protrudes is defined as a front surface.

The fin collar 11 has a cylindrical shape, and is formed, for example, by drawing to protrude in the stacking direction of the plurality of fins 1 that is a direction perpendicular to the front surface of the fin 1. The fin collars 11 are arranged, for example, in two rows in the flow direction of the air WF orthogonal to the stacking direction of the fins 1, that is, the row direction, and in a plurality of stages in a direction perpendicular to the flow direction of the air WF, that is, the stage direction, in such a manner that the fin collars 11 are arranged in a staggered manner. The resin parts 12 each have a cylindrical shape having an inner diameter larger than an outer diameter of the fin collar 11, and are each positioned on an outer periphery of the fin collar 11 to surround the fin collar 11. The inner diameter of the resin part 12 is larger than the outer diameter of the fin collar 11, and the center axis of the resin part 12 and the center axis of the fin collar 11 coincide with each other. The inner diameter of the resin part 12 may be substantially equal to the outer diameter of the fin collar 11, and in this case, the fin collar 11 is fitted to the resin part 12, thereby preventing shifting of the resin part 12 in the inner surface direction of the fin 1. The outer peripheral surface of the resin part 12 and the inner peripheral surface of the fin collar 11 may partially be bonded to each other to increase the strength against a force in the in-surface direction of the fin 1. The fin collar 11 is one example of a second fin of the present invention.

The resin parts 12 are inserted between the plurality of fins 1, and the plurality of fins 1 are continuously stacked with the resin parts 12 interposed between the plurality of fins 1 so that the centers of the fin collars 11 formed on the respective fins 1 coincide with one another. The liquid passage pipe 13 is formed by the fin collars 11 that are continuously arranged and by the resin parts 12 that are held in close contact with the fins 1 on the outer peripheral surfaces of the fin collars 11 between the stacked fins 1. The resin part 12 has the inner diameter larger than an outer diameter of the opening 110 on which the fin collar 11 is positioned, and the fin collar 11 protrudes further inside than is the resin part 12. The height of the fin collar 11 in the stacking direction is smaller than the height of the resin part 12 in the stacking direction, and a heat transfer medium that is a fluid flows in or out through a clearance secured between an edge portion of the fin collar 11 and the back surface of the fin 1 facing the fin collar 11.

An inlet header 2 provided close to the downstream of the flow of the air WF and an outlet header 3 provided close to the downstream of the flow of the air WF are connected to one end of the plurality of stacked fins 1 by a plurality of connection pipes 4. The outlet header 3 is connected to the resin part 12 arranged on the fin 1 at the one end of the stacked fins 1 in such a manner that flanges of the plurality of connection pipes 4 branched from the outlet header 3 are interposed between the outlet header 3 and the resin part 12. With the same configuration as the outlet header 3, the inlet header 2 is connected to the resin part 12 on the fin 1 arranged at the one end. The inlet header 2 and the outlet header 3 are each connected to the liquid passage pipes 13 through a corresponding one of the resin parts 12 to which the inlet header 2 or the outlet header 3 is connected. Further, the inlet header 2 and the outlet header 3 are connected by U-shaped pipes (not shown) for connecting the liquid passage pipes 13 extending from the inlet header 2 and the liquid passage pipes 13 extending toward the outlet header 3 at another end of the plurality of stacked fins 1.

<Operation of Heat Exchanger 10>

Next, an operation of the heat exchanger 10 according to Embodiment 1 is described, as an example, with an application case in which hot water or cold water is used as a heat transfer medium, and the heat exchanger 10 is accommodated in an indoor unit of an air-conditioning apparatus.

In a heating operation of the air-conditioning apparatus, the heat transfer medium is heated through heat exchange in an outdoor unit, and flows into the indoor unit as hot water RF. The hot water RF flows in through the inlet header 2 of the heat exchanger 10 accommodated in the indoor unit, and passes through the connection pipes 4 to flow through the respective liquid passage pipes 13 located close to the downstream of the air WF. The hot water RF having flowed through the respective liquid passage pipes 13 close to the downstream of the air WF passes through the U-shaped pipes to flow through the liquid passage pipes 13 located close to the upstream of the air WF. The hot water RF having flowed through the liquid passage pipes 13 close to the upstream of the air WF passes through the respective connection pipes 4, and is merged in the outlet header 3 to flow through the outlet header 3. Then, the hot water RF flows out toward the outdoor unit. In a cooling operation of the air-conditioning apparatus, the heat transfer medium is cooled through heat exchange in the outdoor unit, and flows into the indoor unit as the cold water RF. Then, the cold water RF flows through the heat exchanger 10. A flow of the cold water RF in the heat exchanger 10 is the same as the flow during the heating operation.

The air WF in an indoor space is sucked by a fan of the indoor unit, and is sent to the indoor space in the flow direction of the air WF through the heat exchanger 10. The air WF sucked by the fan flows into a fin core 14 between the fins 1 adjacent to each other in the stacking direction, from the direction orthogonal to the stacking direction of the fins 1. The air WF exchanges heat with the hot water RF in the liquid passage pipes 13 located close to the windward, and exchanges heat with the hot water RF in the liquid passage pipes 13 located close to the leeward. In this manner, the air WF turns into hot air, and flows out to the indoor space. In a case during the cooling operation, the air WF turned into cold air by the cold water RF flowing through the liquid passage pipes 13 close to the leeward and the liquid passage pipes 13 close to the windward is sent to the indoor space.

<Manufacturing Method of Heat Exchanger 10>

In manufacture of the heat exchanger 10, first, the resin parts 12 are arranged around the fin collars 11 formed on the first fin 1. Next, the second fin 1 is stacked on the first fin 1, and the resin parts 12 arranged on the first fin 1 and the back surface of the second fin 1 are joined to each other by an adhesive, and are sealed. At this time, the centers of the fin collars 11 of the first fin 1 and the centers of the fin collars 11 of the second fin 1 coincide with each other. Then, the resin parts 12 are arranged around the fin collars 11 formed on the second fin 1. Next, the third fin 1 is stacked on the second fin 1, and the resin parts 12 arranged on the second fin 1 and the back surface of the third fin 1 are joined to each other by an adhesive, and are sealed. Also in this case, the centers of the fin collars 11 on the second fin 1 and the centers of the fin collars 11 of the third fin 1 coincide with each other. The fourth and subsequent fins are stacked similarly, and the heat exchanger 10 in which the liquid passage pipes 13 are formed by the fin collars 11 on the plurality of stacked fins 1 is obtained. In the heat exchanger 10, the liquid passage pipes 13 sealed by the resin parts 12 are formed by the stacked fins 1 in two rows in the row direction, and the plurality of liquid passage pipes 13 sealed by the resin parts 12 are formed by the stacked fins 1 in the stage direction in each row.

In the related-art heat exchanger, when the resin film of the inner surface of each of the fin collars is formed to be thick to enhance the strength or the anticorrosive performance, degradation in heat exchange performance caused by increase in heat resistance is unavoidable. In contrast, in the heat exchanger 10 according to Embodiment 1, the liquid passage pipes 13 are sealed by the resin parts 12 arranged further outside than are the fin collars 11. Consequently, both heat exchange performance and reliability in the strength and against corrosion can be ensured by direct contact, to the heat medium, of the fins 1 protruding toward an interior. Even when corrosion occurs, the corrosion hardly occurs in the surface direction of the fins, and hence degradation in sealing performance is prevented.

In the description above, the fin 1 made of aluminum is described. Further, a layer of a base metal material, which has a higher ionization tendency and is more easily corroded than that of the material of the fin 1, may be provided on the front surface of the fin 1. For example, when the fin 1 is made of aluminum, a layer of a material, such as zinc, that is more easily corroded than aluminum is provided. With this configuration, corrosion that occurs on the fin 1 is prevented from propagating in the front surface direction of the fin 1. Further, the front surface of the fin 1 may be covered by a layer, such as a resin coating layer, that is more hardly corroded than the fin 1.

Modification Example 1 of Embodiment 1

Figure 4:
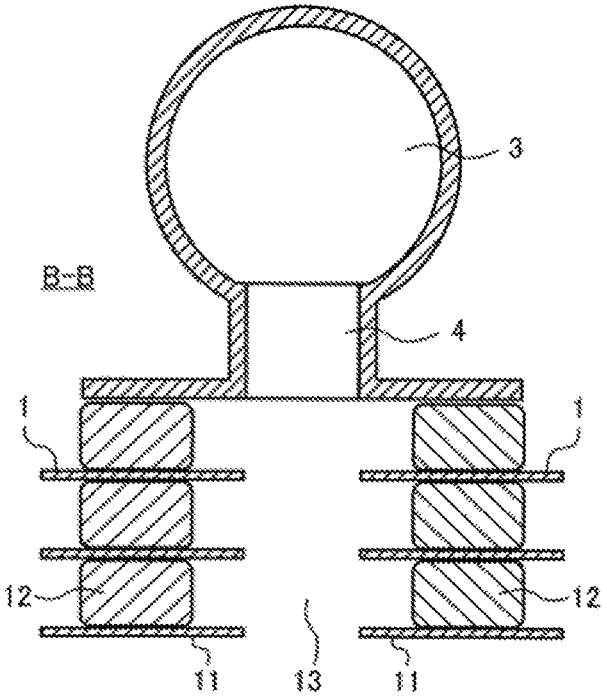
FIG. 4 is a schematic view for illustrating fins of the heat exchanger according to Modification Example 1 of Embodiment 1.

FIG. 4 is a schematic view for illustrating the fins 1 of the heat exchanger 10 according to Modification Example 1 of Embodiment 1. FIG. 4 is a schematic view corresponding to FIG. 3 referred to in the description above. As illustrated in FIG. 4, in the heat exchanger 10 according to Modification Example 1 of Embodiment 1, the resin parts 12 are arranged with the openings 110 centered, and the fin collars 11 each having a cylindrical shape and protruding in the stacking direction are not formed. In this manner, similarly to Embodiment 1, with the resin parts 12 and the openings 110, both enhancement in heat exchange performance and ensuring of reliability in the strength and against corrosion can be obtained, and in addition, the manufacture can be simplified.

Modification Example 2 of Embodiment 1

Figure 5:
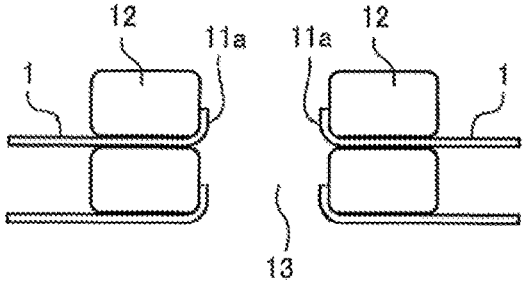
FIG. 5 is a schematic view for illustrating fin collars of the heat exchanger according to Modification Example of Embodiment 1.

FIG. 5 is a schematic view for illustrating fin collars 11*a* of the heat exchanger 10 according to Modification Example of Embodiment 1. FIG. 5 is a schematic view corresponding to FIG. 3 referred to in the description above. As illustrated in FIG. 5, the fin collars 11*a* of the heat exchanger 10 according to Modification Example of Embodiment 1 each have an outer diameter equal to an inner diameter of the resin part 12, and the resin parts 12 are arranged to be fitted to the fin collars 11. With this configuration, shifting of the resin parts 12 in the inner surface direction of the fin 1 can be prevented. The outer peripheral surface of the fin collar 11 and the inner peripheral surface of the resin part 12 may partially be bonded to each other. With this configuration, the strength against a force in the inner surface direction of the fin 1 is increased.

In the description above, the numbers of array of the liquid passage pipes 13 in the row direction and the stage direction are not limited to the numbers illustrated in Embodiment 1, and may be any number. Further, the air WF and the water RF may be subjected to heat exchange by a pseudo parallel flow by reversing the flow of the air WF instead of heat exchange by a pseudo counter flow.

Further, in the description above, the resin part 12 having a cylindrical shape with a circular cross section is described as one example. However, the shape of the resin part 12 is not limited to the circular shape, and the resin part 12 may have a cross section of a polygonal shape such as a triangular shape and a quadrangular shape. The interface between the fin 1 and the resin part 12 inserted between the fins 1 may be joined by an adhesive. Alternatively, a part having adhesiveness is formed into a ring shape, and the ring-shaped part may be joined to the fin 1 through melting and solidification by heating treatment at a temperature of from about 100 degrees Celsius to about 300 degrees Celsius. Further, instead of the configuration in which the fins 1 and the resin parts 12 are alternately stacked on one another, a reactive foaming agent such as urethane foam may be applied around the fin collars 11, or an adhesive in which microcapsules having a thermal expansion property are mixed may be applied. In this case, when the fins 1 are to be stacked, the fins 1 are joined to each other by foaming or expanding the reactive foaming agent or the adhesive by heating treatment at a temperature of from about 100 degrees Celsius to about 300 degrees Celsius. With this configuration, the reactive foaming agent or the adhesive is pervaded to seal the clearances between the fins 1. In this manner, the fins 1 are joined to each other. The number of components is reduced as compared to the case in which the fins 1 and the resin parts 12 are alternately stacked on one another, and further, the ease of assembly can be enhanced.

In the heat exchanger 10 according to Embodiment 1 described above, the fin collars 11 are formed on one surface of each of the fins 1 to protrude in the perpendicular direction, and the resin parts 12 each having a cylindrical shape are arranged on the outer peripheries of the fin collars 11. The plurality of fins 1 are stacked on one another with the resin parts 12 interposed between the plurality of fins 1, and the fin collars 11 and the resin parts 12 form the liquid passage pipes 13. The liquid passage pipes 13 are each sealed by the resin parts 12 on the outer periphery of the liquid passage pipe 13, and hence the liquid contact area between the fin collar 11 and the heat transfer medium is increased. With this configuration, as compared to the case in which the inner surface of the fin collar 11 is sealed by covering with resin, the heat resistance between the fluid and the fin 1 is reduced, and the heat exchange performance of the heat exchanger 10 is enhanced. Further, even when the resin parts 12 arranged on the outer peripheral surface of the liquid passage pipe 13 are formed to be thick to enhance the joining strength and the sealing performance, the heat exchange is not hindered. The liquid contact area is increased, and hence a corrosion allowance, which is a margin usable in occurrence of corrosion of the fin 1, can be increased. Thus, even when corrosion occurs, propagation of the corrosion can be prevented. Further, even when corrosion propagates in the plate thickness direction of the fin 1 to penetrate the fin 1, the liquid passage pipe 13 is sealed by the resin parts 12 on the outer peripheral surface of the liquid passage pipe 13. Thus, the sealing performance of the liquid passage pipe 13 is not degraded, and the corrosion direction and the electrical heat direction extend, so that degradation in heat transfer characteristics is also prevented.

Further, in the heat exchanger 10 according to Embodiment 1, the fin collars 11 each have a cylindrical shape. Thus, the strength of the fin 1 is enhanced due to the rib effect, and in addition, the straightness at the time of stacking and assembling the fins 1 is excellent. The fins 1 can be smoothly stacked, so that the ease of assembly is enhanced, accordingly. Further, the strength against bending, torsion, or shear to be applied to the joining portion when the heat exchanger 10 is installed, for example, in a casing of the indoor unit or is conveyed is also enhanced.

Further, in the heat exchanger 10 according to Embodiment 1, a layer of a base metal material, which has a higher ionization tendency and is more easily corroded than that of the material of the fin 1, may be provided on the front surface of the fin collar 11. For example, when the fin 1 is made of aluminum, a layer of a material, such as zinc, that is more easily corroded than aluminum only needs to be provided. With this configuration, it is possible to prevent such a situation that corrosion that occurs on the fin 1 propagates in the front surface direction of the fin 1 to a plurality of positions in the plate thickness direction, so that the fin collars 11 are broken and fall, thereby the liquid contact area can be maintained.

Further, in the heat exchanger 10 according to Embodiment 1, the front surface of the fin collar 11 is covered by the layer, such as the resin coating layer, that is hardly corroded, thereby propagation of corrosion of the fin 1 can be further prevented.

Embodiment 2

Figure 6:
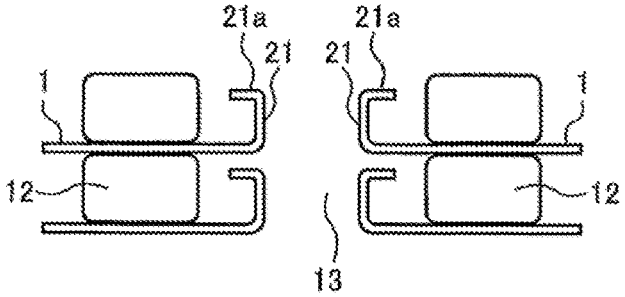
FIG. 6 is a schematic view for illustrating a cross section of fin collars of the heat exchanger according to Embodiment 2.

FIG. 6 is a schematic view for illustrating a cross section of fin collars 21 of the heat exchanger 10 according to Embodiment 2. As illustrated in FIG. 6, the fin collar 21 of the heat exchanger 10 according to Embodiment 2 is different from that of Embodiment 1 in that a flange portion 21*a* is formed at a distal end of the cylindrical shape. Other configurations of the heat exchanger 10 according to Embodiment 2 are similar to those of Embodiment 1. Consequently, description of the other configurations is omitted, and parts that are the same as or correspond to those of the heat exchanger 10 according to Embodiment 1 are denoted by the same reference signs.

The fin collars 21 each have a cylindrical shape protruding in the stacking direction of the plurality of fins 1, and the distal end of the fin collar 21 is the flange portion 21*a* formed by being bent toward the outer periphery in a direction of separating from the center axis of the fin collar 21. The flange portion 21*a* is positioned closer to the resin part 12 arranged on the outer periphery of the fin collar 21, and is folded back in a direction of increasing the inner diameter of the cylindrical shape of the fin collar 21. The fin collar 21 is another example of the second fin of the present invention.

In the liquid passage pipe 13 formed by the fin collars 21 and the resin parts 12, the fin collars 21 and the flange portions 21*a* are provided, and the heat transfer medium comes into contact at the fin collars 21 and the flange portions 21*a*, so that heat is exchanged.

In the description above, the example in which the flange portion 21*a* is formed by bending the distal end of the fin collar 11 in the outer peripheral direction is described. However, the flange portion 21*a* may be formed by bending the distal end of the fin collar 11 in the inner peripheral direction, that is, in a direction of approaching the center axis of the fin collar 11. Further, the flange portion 21*a* may be formed by bending the distal end of the fin collar 21 not only one time but a plurality of times to increase the liquid contact area. Through the increase in liquid contact area, the heat exchange performance and the anticorrosive reliability can also be enhanced.

It is desired that the height of the fin collar 11 in the stacking direction be smaller than the thickness of the resin part 12, that is, the interval of the plurality of fins 1. With this configuration, the heat transfer medium present in a region in the liquid passage pipe 13 in which a fluid flows easily flows in or out between the periphery of the resin parts 12 and the liquid passage pipe 13, and hence a difference in dissolved-oxygen concentration in the fluid hardly occurs. Consequently, propagation of local corrosion can be prevented, thereby further enhancing the corrosion reliability.

In the heat exchanger 10 according to Embodiment 2 described above, the distal end of the fin collar 11 is extended in the outer peripheral direction or the inner peripheral direction to form the flange portion 21*a*. Consequently, the liquid contact area in which the heat transfer medium and the fin collar 11 come into contact is increased, thereby enhancing the heat exchange performance. Further, the corrosion allowance usable in occurrence of corrosion is increased, thereby propagation of corrosion can be prevented.

Embodiment 3

Figure 7:
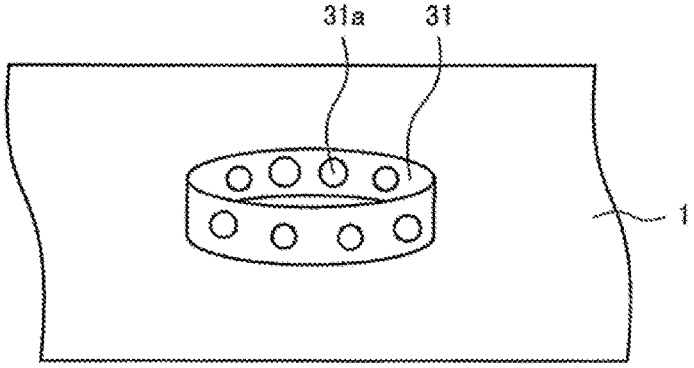
FIG. 7 is a perspective view of a fin collar of the heat exchanger according to Embodiment 3.

FIG. 7 is a perspective view of a fin collar 31 of the heat exchanger 10 according to Embodiment 3. As illustrated in FIG. 7, the fin collar 31 of the heat exchanger 10 according to Embodiment 3 is different from that of Embodiment 1 in that a plurality of liquid passage holes 31*a* are provided in a side surface of a cylindrical shape. Other configurations of the heat exchanger 10 according to Embodiment 3 are similar to those of Embodiment 1. Consequently, description of the other configurations is omitted, and parts that are the same as or correspond to those of the heat exchanger 10 according to Embodiment 1 are denoted by the same reference signs.

The fin collar 31 has a cylindrical shape protruding from the front surface of the fin 1 in the stacking direction of the plurality of fins 1, and the plurality of liquid passage holes 31*a* are provided in the side surface. The liquid passage holes 31*a* pass through the side surface of the fin collar 31, and each have, for example, a circular shape having a diameter of one-third of the height of the cylindrical shape. Ten liquid passage holes 31*a* are provided at equal intervals in a circumferential direction of the cylindrical shape. The fin collar 31 is another example of the second fin of the present invention.

The liquid passage holes 31*a* cause the heat transfer medium to flow between the fin collar 31 and the resin part 12 arranged on the outer periphery of the fin collar 31. The heat transfer medium flowing through the liquid passage pipe 13 formed by stacking the fin collars 31 and the resin parts 12 comes into contact with the fin collars 31 while flowing in and out through the liquid passage holes 31*a* of the fin collars 31. In this manner, heat is exchanged.

In the heat exchanger 10 according to Embodiment 3 described above, the liquid passage holes 31*a* are provided in the side surface of the fin collar 31 having a cylindrical shape, and thus, inflow and outflow of the heat transfer medium between the fin collar 31 and the resin part 12 is further promoted. With this configuration, the dissolved-oxygen concentration is further equalized in the heat transfer medium, and thus, propagation of corrosion due to local corrosion can be further prevented, thereby further enhancing the corrosion reliability.

Modification Example of Embodiment 3

Figure 8:
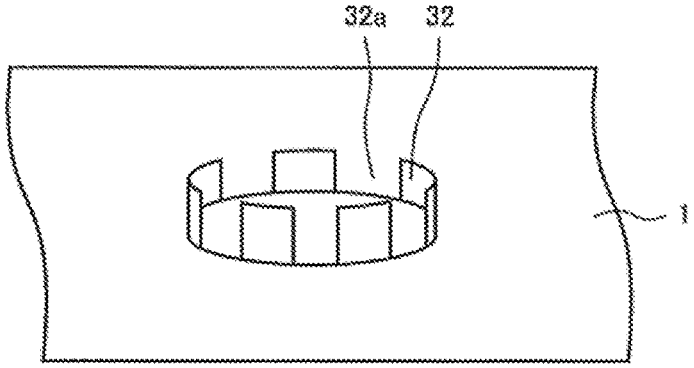
FIG. 8 is a perspective view of a fin collar of the heat exchanger according to Modification Example of Embodiment 3.

FIG. 8 is a perspective view of a fin collar 32 of the heat exchanger 10 according to Modification Example of Embodiment 3. As illustrated in FIG. 8, the fin collar 32 of the heat exchanger 10 according to Modification Example of Embodiment 3 has a plurality of slits 32*a* instead of the plurality of liquid passage holes 31*a*.

The slits 32*a* are formed in a side surface of the fin collar 32 having a cylindrical shape. The slits 32*a* are formed by, for example, when the fin collar 32 having a cylindrical shape is to be manufactured by drawing or other processing, punching the fin collar 32 into slit shapes in advance, and then, raising the fin collar 32 into a cylindrical shape in the stacking direction. The plurality of slits 32*a* are formed in the fin collar 32, and hence the heat transfer medium flows in and out through the slits 32*a*, thereby the same effect in the liquid passage holes 31*a* each having a circular shape can be attained.

In the heat exchanger 10 according to Embodiment 3 described above, the slits 32*a* are formed in the side surface of the fin collar 32, and thus, inflow and outflow of the heat transfer medium between the fin collar 31 and the resin part 12 is further promoted. Also in this case, the dissolved-oxygen concentration is further equalized in the heat transfer medium, and thus, propagation of corrosion due to local corrosion can be further prevented, thereby further enhancing the corrosion reliability.

Embodiment 4

Figure 9:
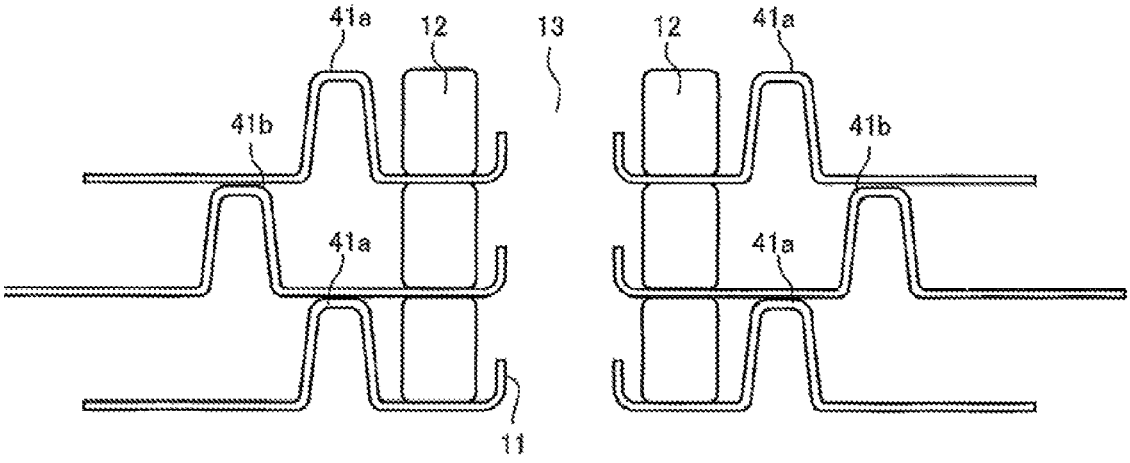
FIG. 9 is a schematic view for illustrating a cross section of a periphery of fin collars of the heat exchanger according to Embodiment 4.
Figure 10:
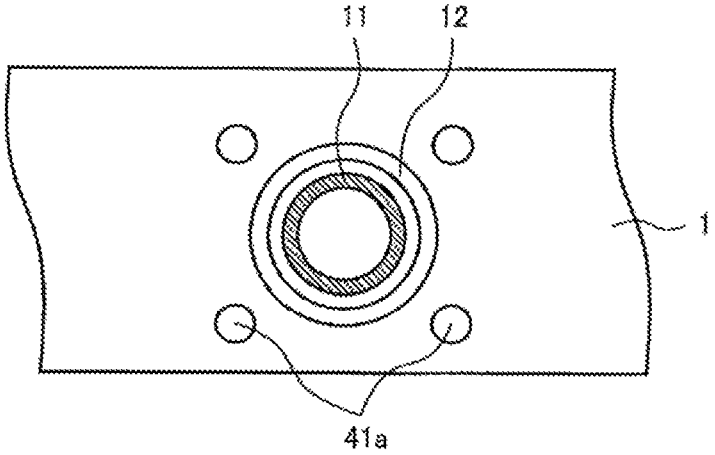
FIG. 10 is a top view of the periphery of the fin collars of the heat exchanger according to Embodiment 4.

FIG. 9 is a schematic view for illustrating a cross section of the periphery of the fin collars 11 of the heat exchanger 10 according to Embodiment 4. FIG. 10 is a top view of the periphery of the fin collars 11 of the heat exchanger 10 according to Embodiment 4. As illustrated in FIG. 9 and FIG. 10, Embodiment 4 is different from Embodiments 1 to 3 in that a plurality of protrusions 41*a* and 41*b* are formed on the periphery of the fin collars 11 of the heat exchanger 10 according to Embodiment 4. Other configurations of the heat exchanger 10 according to Embodiment 4 are similar to those of Embodiments 1 to 3. Consequently, description of the other configurations is omitted, and parts that are the same as or correspond to those of the heat exchanger 10 according to Embodiments 1 to 3 are denoted by the same reference signs.

The plurality of protrusions 41*a* and 41*b* are arranged on the fins 1 on the outer peripheries of the resin parts 12 arranged on the outer peripheries of the fin collars 11 that protrude from the front surfaces of the fins 1 in the stacking direction. The plurality of protrusions 41*a* and 41*b* protrude from the front surfaces of the fins 1 in the stacking direction, and are formed to have substantially the same height in the stacking direction as the height of the resin part 12 in the stacking direction. The plurality of protrusions 41*a* have a shape such as a circular shape in top view, and are formed at positions on the outer periphery of the resin part 12. The plurality of protrusions 41*b* have a shape such as a circular shape in top view, and are formed at positions on the outer periphery of the resin part 12. The plurality of protrusions 41*a* and the plurality of protrusions 41*b* have substantially the same shape, and are arranged at positions shifted from each other in the stacking direction. The plurality of fins 1 are stacked on one another so that the upper surfaces of the plurality of protrusions 41*a* and 41*b* and the upper surfaces of the resin parts 12 are held in contact with the back surfaces of the fins 1. With the plurality of protrusions 41*a* and 41*b* formed on the fins 1, the fin 1 is prevented from being inclined to the adjacent fin 1, and a distance between the stacked fins 1 is maintained to be constant. In the stacked fins 1, positions of the protrusions 41*a* and positions of the protrusions 41*b* of the adjacent fins 1 are shifted from each other, thereby easily maintaining the distance between the fins 1.

The back surface of the fin 1 and the upper surface of each of the protrusions 41*a* and 41*b* only need to be bonded by, for example, an adhesive. Further, the following configuration may be employed. Specifically, as the resin part 12, a reactive foaming agent or an adhesive in which microcapsules having a thermal expansion property are mixed is used, and is reacted to be expanded after assembly so that the clearance between the fins is sealed. The protrusions 41*a* and 41*b* may each have a circular cylindrical shape with a circular shape in top view, but may have a cuboid shape with a rectangular shape in top view. The shape of the protrusions 41*a* and 41*b* is not limited.

Figure 11:
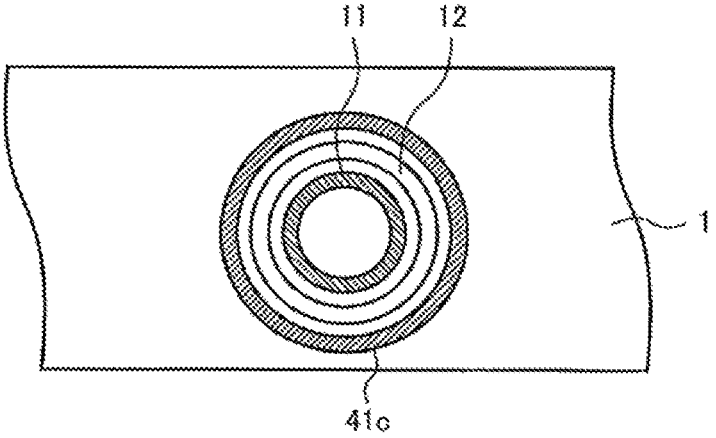
FIG. 11 is a top view of a protrusion of the heat exchanger according to Embodiment 4.

FIG. 11 is a top view of a protrusion 41*c* of the heat exchanger 10 according to Embodiment 4. As illustrated in FIG. 11, the protrusion 41*c* has an annular shape having an inner diameter larger than a diameter of the resin part 12 in top view. As described above, the protrusion 41*c* may be formed into an annular shape surrounding the resin part 12 in top view, and also in this case, the distance between the stacked fins 1 is maintained to be constant.

<Operation of Heat Exchanger 10>

Next, an operation of the heat exchanger 10 according to Embodiment 4 is described with an example case in which the heat exchanger 10 is positioned in the indoor unit, and a heating operation is performed. The hot water RF flows into the heat exchanger 10 through the inlet header 2 of the heat exchanger 10, and flows into the liquid passage pipes 13 through the connection pipes 4. The hot water RF having flowed into the liquid passage pipes 13 exchanges heat at the fin collars 11 arranged inside the liquid passage pipes 13, and flows out through the outlet header 3. Heat transferred from the hot water RF to the fin collars 11 moves from the fin collars 11 to reach the fins 1 and the plurality of protrusions 41*a* and 41*b* arranged closer to the outer periphery than are the resin parts 12 of the fins 1. Then, the heat is rejected, at the fins 1 and the plurality of protrusions 41*a* and 41*b* that protrude from the fins 1, to the air WF flowing around. In this manner, air in an indoor space is heated. With the plurality of protrusions 41*a* and 41*b*, the contact area between the fins 1 and the air WF is increased to enhance the efficiency of the heat exchange.

Modification Example 1 of Embodiment 4

Figure 12:
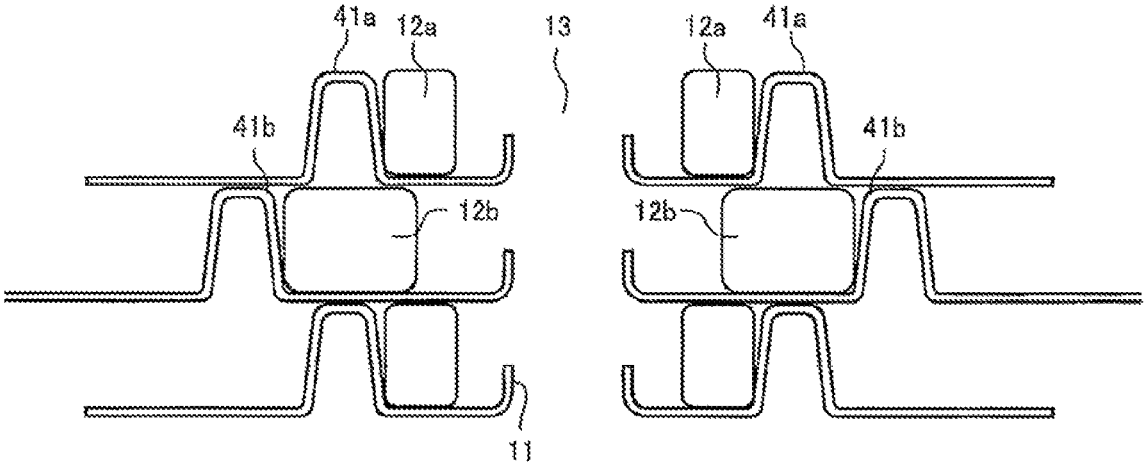
FIG. 12 is a schematic view for illustrating a cross section of a periphery of fin collars of the heat exchanger according to Modification Example 1 of Embodiment 4.

FIG. 12 is a schematic view for illustrating a cross section of the periphery of the fin collars 11 of the heat exchanger 10 according to Modification Example 1 of Embodiment 4. As illustrated in FIG. 12, the heat exchanger 10 according to Modification Example 1 of Embodiment 4 includes resin parts 12*a* arranged in contact with the inner peripheral surfaces of the protrusions 41*a* and resin parts 12*b* arranged in contact with the inner peripheral surfaces of the protrusions 41*b*.

The resin part 12*a* is formed into an annular shape having an outer diameter equal to or smaller than an inner diameter of the protrusion 41*a*, and an inner diameter larger than the outer diameter of the fin collar 11 in top view. Further, the resin part 12*b* is formed into an annular shape having an outer diameter equal to or smaller than an inner diameter of the protrusion 41*b* arranged closer to the outer periphery than is the protrusion 41*a*, and an inner diameter larger than the outer diameter of the fin collar 11 in top view. The inner diameter of the resin part 12*a* is larger than the inner diameter of the resin part 12*b*. The resin parts 12*a* and 12*b* are fitted to portions that are further inside than are the protrusions 41*a* and 41*b* under a state in which the outer peripheral surfaces of the resin parts 12*a* and 12*b* and the inner peripheral surfaces of the protrusions 41*a* and 41*b* are held in contact with each other.

The resin parts 12*a* and 12*b* are formed into the shapes described above, and thus, an internal pressure of the liquid passage pipe 13 is received by both the resin parts 12*a* and 12*b* and the protrusions 41*a* and 41*b* held in contact with the outer peripheries of the resin parts 12*a* and 12*b*, thereby enhancing the pressure resistance strength of the liquid passage pipe 13. Further, the inner diameter of the resin part 23*b* is increased to increase the liquid contact area between the fins 1 and the heat transfer medium inside the liquid passage pipe 13, thereby increasing the area effective for heat exchange.

Modification Example 2 of Embodiment 4

Figure 13:
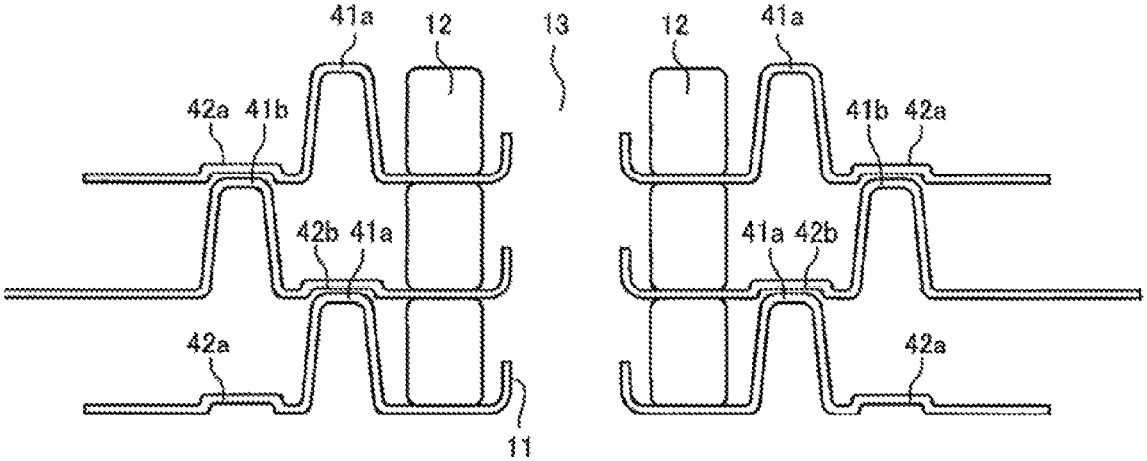
FIG. 13 is a schematic view for illustrating a cross section of a periphery of fin collars of the heat exchanger according to Modification Example 2 of Embodiment 4.

FIG. 13 is a schematic view for illustrating a cross section of the periphery of the fin collars 11 of the heat exchanger 10 according to Modification Example 2 of Embodiment 4. As illustrated in FIG. 13, the heat exchanger 10 according to Modification Example 2 of Embodiment 4 includes the protrusions 41*a* and 41*b* and recessed portions 42*b* and 42*a* into which the upper surfaces of the protrusions 41*a* and 41*b* are inserted.

The recessed portions 42*b* and 42*a* are recessed portions formed in the back surfaces of the fins 1 at positions above the protrusions 41*a* and 41*b*, and are formed to have substantially the same area as that of the upper surfaces of the protrusions 41*a* and 41*b*. Under the state in which the plurality of fins 1 are stacked on one another, the upper surfaces of the protrusions 41*a* and 41*b* are inserted into the recessed portions 42*b* and 42*a*, and are held in contact with the back surface sides of the recessed portions 42*b* and 42*a*. The recessed portions 42*b* and 42*a* only need to be formed to have such a depth that the difference between the height of the protrusions 41*a* and 41*b* and the depth of the recessed portions 42*b* and 42*a* is equal to the distance between the adjacent fins 1 and the height of the resin part 12.

The protrusions 41*a* and 41*b* are formed on the front surfaces of the fins 1, and the recessed portions 42*b* and 42*a* are formed in the back surfaces of the fins 1. The protrusions 41*a* and 41*b* are inserted into the recessed portions 42*b* and 42*a* so that the stacked fins 1 are positioned and the centers of the stacked fin collars 11 coincide with each other.

Modification Example 3 of Embodiment 4

Figure 14:
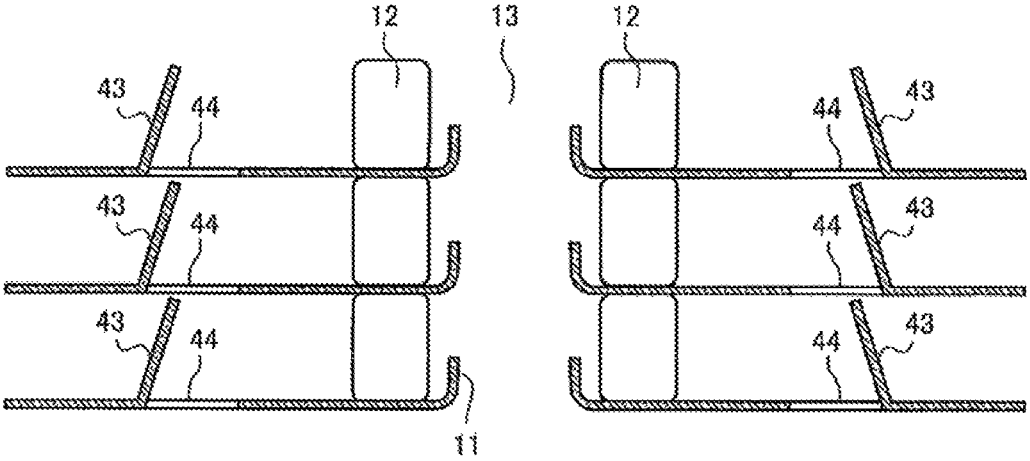
FIG. 14 is a schematic view for illustrating a cross section of a periphery of fin collars of the heat exchanger according to Modification Example 3 of Embodiment 4.

FIG. 14 is a schematic view for illustrating a cross section of the periphery of the fin collars 11 of the heat exchanger 10 according to Modification Example 3 of Embodiment 4. As illustrated in FIG. 14, the heat exchanger 10 according to Modification Example 3 of Embodiment 4 includes cut-and-raised portions 43 and cutout portions 44 on the fin 1 on the outer periphery of the resin parts 12.

The cut-and-raised portions 43 are formed in such a manner that the plurality of cutout portions 44 are formed in the fin 1, and cut pieces obtained as a result of formation of the cutout portions 44 are raised in the stacking direction of the fins 1. The cutout portions 44 only need to be formed in a direction parallel to the flow direction of the air WF, and the cut-and-raised portions 43 are formed, for example, to have a height in the stacking direction that is substantially the same as the interval of the stacked fins 1. The cut-and-raised portions 43 are parallel to the flow of the air WF in the direction orthogonal to the stacking direction of the fins 1, and hence contact with the air WF is easy. Heat transfer between the fins 1 and the air WF is promoted due to the front edge effect.

Figure 15:
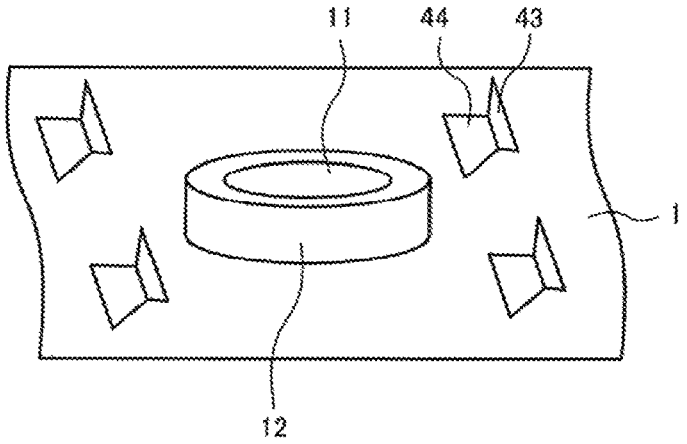
FIG. 15 is a perspective view of the periphery of the fin collar of the heat exchanger according to Modification Example 3 of Embodiment 4.

FIG. 15 is a perspective view of the periphery of the fin collar 11 of the heat exchanger 10 according to Modification Example 3 of Embodiment 4. As illustrated in FIG. 15, the cut-and-raised portions 43 of the fin 1 according to Modification Example 3 of Embodiment 4 may be each formed into a trapezoidal shape. When the cut-and-raised portions 43 are each formed into a trapezoidal shape, the cut-and-raised portions 43 can also have a function of maintaining the distance between the fins 1.

The configuration of Embodiment 4 described above may be employed in any of Embodiments 1 to 3 depending on a combination.

In the heat exchanger 10 according to Embodiment 4 described above, the protrusions 41*a* and 41*b* that protrude from the front surfaces of the fins 1 are formed on the outer peripheries of the fin collars 11 and the resin parts 12. With this configuration, when the fins 1 are stacked to assemble the heat exchanger 10, the distance between the fins 1 is maintained properly, thereby enhancing the ease of assembly. In particular, in a case in which a reactive foaming agent or an adhesive in which microcapsules having a thermal expansion property are mixed is used as the resin part 12, when the reactive foaming agent or the adhesive is reacted to be expanded after assembly so that the clearance between the fins 1 is sealed, the distance between the adjacent fins 1 is maintained, thereby enhancing the ease of assembly.

Further, in the heat exchanger 10 according to Embodiment 4, the protrusions 41*a* and 41*b* are formed into the plurality of circular cylindrical shapes or cuboid shapes. Thus, the distance between the adjacent fins 1 is constant, thereby enhancing the ease of assembly.

Further, in the heat exchanger 10 according to Embodiment 4, the protrusions 41*a* and 41*b* are each formed into an annular shape surrounding the resin part 12 arranged on the outer periphery of the fin collar 11. Thus, the distance between the stacked fins 1 is maintained to be constant, thereby enhancing the ease of assembly.

Further, in the heat exchanger 10 according to Embodiment 4, in the back surfaces of the fins 1, there are formed the recessed portions 42*b* and 42*a* into which the upper surfaces of the protrusions 41*a* and 41*b* are inserted. With this configuration, the distance between the adjacent fins 1 is constant, and shifting of the positions of the stacked fin collars 11 is prevented.

Further, in the heat exchanger 10 according to Embodiment 4, the cutout portions 44 and the cut-and-raised portions 43 are formed on the fin 1 on the outer periphery of the resin part 12. With the cut-and-raised portions 43, contact between the fins 1 and the air WF is easy, and heat transfer between the fins 1 and the air WF is promoted due to the front edge effect.

Embodiment 5

The fin collar 11 of the heat exchanger 10 according to Embodiment 5 is different from those of Embodiments 1 to 4 in that the fin collar 11 includes a protruding portion 11*b* protruding toward the interior.

Figure 16:
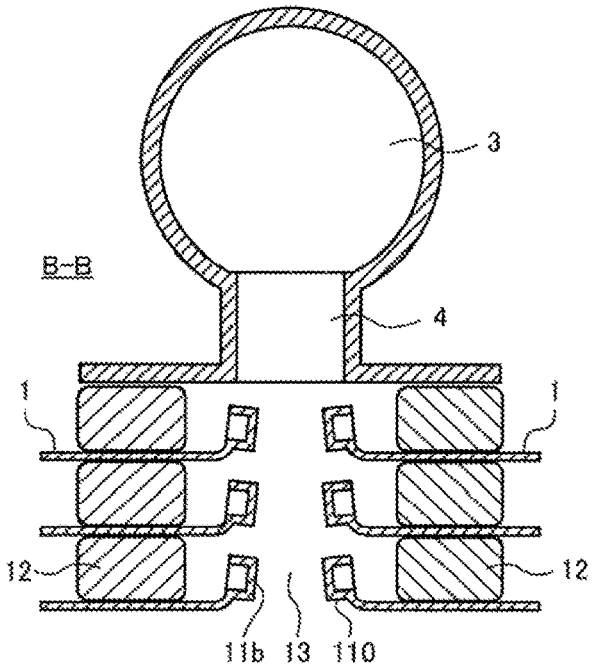
FIG. 16 is a schematic view for illustrating fin collars of the heat exchanger according to Embodiment 5.
Figure 17:
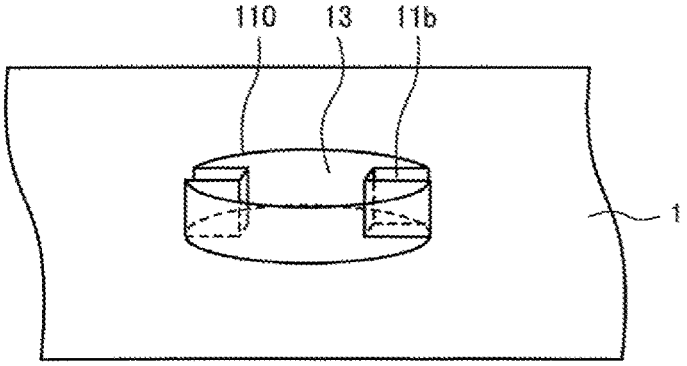
FIG. 17 is a perspective view of the fin collar of FIG. 16.

FIG. 16 is a schematic view for illustrating the fin collars 11 of the heat exchanger 10 according to Embodiment 5. FIG. 17 is a perspective view of the fin collar 11 of FIG. 16. FIG. 16 is a schematic view corresponding to FIG. 3 referred to in the description of Embodiment 1. As illustrated in FIG. 16 and FIG. 17, the heat exchanger 10 according to Embodiment 5 includes the plurality of stacked fins 1, the fin collars 11 formed on the fins 1, and the resin parts 12, which are cylindrical portions.

Each of the plurality of fins 1 is a part having a flat plate shape and being made of metal such as aluminum, and the plurality of fins 1 are stacked in a direction orthogonal to the flow direction of the air. That is, the plurality of fins 1 are arrayed at intervals. The plurality of openings 110 are provided in a surface of each of the fins 1.

The plurality of fins 1 are stacked on one another with the resin parts 12, which are the cylindrical parts, interposed between the plurality of fins 1 while the centers of the plurality of openings 110 coincide with each other. The stacked openings 110 and the resin parts 12 form the liquid passage pipe 13 in the stacking direction of the plurality of fins 1. That is, in the stacked fins 1, the liquid passage pipes 13 are formed in two rows in the row direction, and the plurality of liquid passage pipes 13 are formed in the stage direction in each row. Each of the resin parts 12 has a cylindrical shape having an inner diameter larger than the outer diameter of the opening 110, and is positioned on the outer periphery of the opening 110 to surround the opening 110. The inner diameter of the resin part 12 is larger than the outer diameter of the opening 110, and the center axis of the resin part 12 and the center axis of the opening 110 coincide with each other. The resin part 12 is one example of the cylindrical part of the present invention.

The fin collar 11 protruding from one surface of each of the fins 1 in the stacking direction is formed around the opening 110. On the fin collar 11, the protruding portions 11*b* having a rectangular shape and protruding toward the interior are formed, and are arranged along a flow of a fluid flowing through the liquid passage pipe 13. The two protruding portions 11*b* are formed and arranged at positions opposite to each other. The fin collar 11 is one example of the second fin of the present invention.

The inlet header 2 provided close to the downstream of the flow of the air WF and the outlet header 3 provided close to the downstream of the flow of the air WF are connected to one end of the plurality of stacked fins 1 by the plurality of connection pipes 4. The outlet header 3 is connected to the resin part 12 arranged on the fin 1 at the one end of the stacked fins 1 in such a manner that flanges of the plurality of connection pipes 4 branched from the outlet header 3 are interposed between the outlet header 3 and the resin part 12. With the same configuration as the outlet header 3, the inlet header 2 is connected to the resin part 12 on the fin 1 arranged at the one end. The inlet header 2 and the outlet header 3 are each connected to the liquid passage pipes 13 through the corresponding one of the resin parts 12 to which the inlet header 2 or the outlet header 3 is connected. Further, the inlet header 2 and the outlet header 3 are connected by U-shaped pipes (not shown) for connecting the liquid passage pipes 13 extending from the inlet header 2 and the liquid passage pipes 13 extending toward the outlet header 3 at another end of the plurality of stacked fins 1.

<Operation of Heat Exchanger 10>

Next, an operation of the heat exchanger 10 according to Embodiment 5 is described with, as an example, an application case in which hot water or cold water is used as a heat transfer medium, and the heat exchanger 10 is accommodated in an indoor unit of an air-conditioning apparatus.

In a heating operation of the air-conditioning apparatus, the heat transfer medium is heated through heat exchange in an outdoor unit, and flows into the indoor unit as the hot water RF. The hot water RF flows in through the inlet header 2 of the heat exchanger 10 accommodated in the indoor unit, and passes through the connection pipes 4 to flow through the respective liquid passage pipes 13 located close to the downstream of the air WF. The hot water RF having flowed through the respective liquid passage pipes 13 close to the downstream of the air WF passes through the U-shaped pipes to flow through the liquid passage pipes 13 located close to the upstream of the air WF. The hot water RF having flowed through the liquid passage pipes 13 close to the upstream of the air WF passes through the respective connection pipes 4, and is merged in the outlet header 3 to flow through the outlet header 3. Then, the hot water RF flows out toward the outdoor unit. In a cooling operation of the air-conditioning apparatus, the heat transfer medium is cooled through heat exchange in the outdoor unit, and flows into the indoor unit as the cold water RF. Then, the cold water RF flows through the heat exchanger 10. A flow of the cold water RF in the heat exchanger 10 is the same as the flow during the heating operation.

The air WF in an indoor space is sucked by a fan of the indoor unit, and is sent to the indoor space in the flow direction of the air WF through the heat exchanger 10. The air WF sucked by the fan flows into the fin core 14 between the fins 1 adjacent to each other in the stacking direction, from the direction orthogonal to the stacking direction of the fins 1. The air WF exchanges heat with the hot water RF in the liquid passage pipes 13 located close to the windward, and exchanges heat with the hot water RF in the liquid passage pipes 13 located close to the leeward. In this manner, the air WF turns into hot air, and flows out to the indoor space. In a case during the cooling operation, the air WF turned into cold air by the cold water RF flowing through the liquid passage pipes 13 close to the leeward and the liquid passage pipes 13 close to the windward is sent to the indoor space.

In the related-art heat exchanger, when a fluid having relatively high viscosity such as water and an antifreeze solution is caused to flow through the liquid passage pipe, or when the liquid passage pipe is formed to have a small diameter to attain high heat transfer performance, the flow through the liquid passage pipe is laminarized to degrade the heat exchange performance. In contrast, in the heat exchanger 10 according to Embodiment 5, the protruding portions 11*b* are arranged at positions close to the inside of the fin collar 11 and along the flow of the fluid flowing through the liquid passage pipe 13. Thus, even when the flow is laminarized, the heat exchange performance is enhanced due to the front edge effect. The front edge effect refers to an effect in which, in the fins arranged to be isolated in the laminar flow, a thin temperature boundary layer is formed from the leading edge portions of the distal ends to enhance the heat transfer coefficient. In the description above, the case in which the two protruding portions 11*b* are arranged in the circumferential direction of the fin collar 11 is described. The number of the protruding portions 11*b* may be one, and is not limited. However, as the number is increased, the effect of promoting heat transfer can be enhanced.

Figure 18:
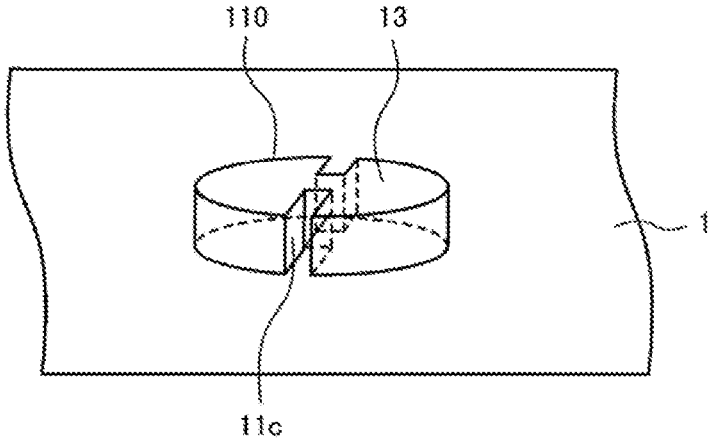
FIG. 18 is a perspective view of the fin collar formed on the fin adjacent to the fin of FIG. 17.

FIG. 18 is a perspective view of the fin collar 11 formed on the fin 1 adjacent to the fin 1 of FIG. 17. As illustrated in FIG. 18, protruding portions 11*c* are formed on the fin 1 adjacent to the fin 1 illustrated in FIG. 17. The protruding portions 11*c* are arranged at positions shifted by a half pitch in the circumferential direction from the protruding portions 11*b*. As described above, the offset fin arrangement in which the protruding portions 11*c* are shifted by a half pitch from the protruding portions 11*b* of the adjacent fin 1 is employed. Thus, an influence exerted by the protruding portions 11*b* arranged close to the upstream on the protruding portions 11*c* arranged close to the downstream of the protruding portions 11*b* is reduced, thereby further enhancing the heat transfer performance.

As described above, the fin collars 11 include the protruding portions 11*b* and 11*c* protruding toward the interior. Thus, even when the flow is laminarized, the heat exchange performance can be enhanced effectively. Due to increase in operation frequency of an air-conditioning apparatus during intermediate seasons such as spring and fall during which an air-conditioning load is relatively small or due to reduction in air-conditioning load caused along with increase in heat insulating property of a building or a house, there is a higher tendency that a flow rate of the water serving as the heat transfer medium is reduced and the flow is laminarized in the operation. Consequently, the need to enhance the heat exchange performance even when the flow is laminarized is becoming more and more important. The protruding portions 11*b* and 11*c* are each one example of a projecting portion having a rectangular shape of the present invention.

Modification Example of Embodiment 5

Figure 19:
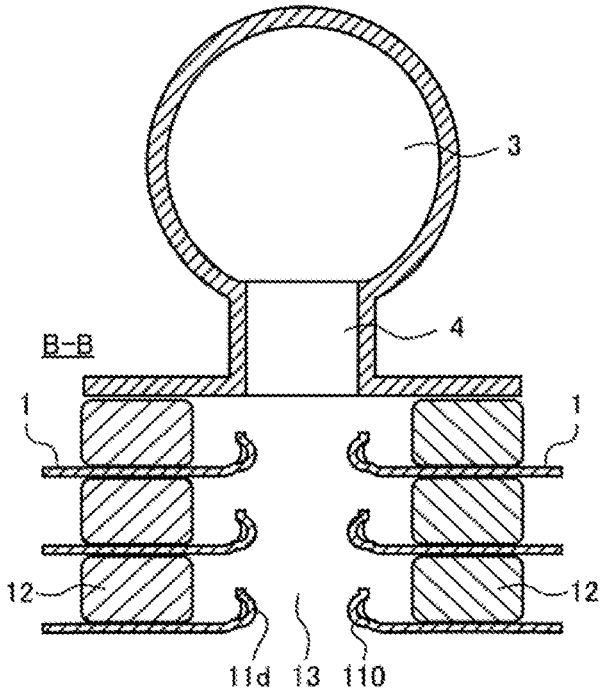
FIG. 19 is a schematic view for illustrating fin collars of the heat exchanger according to Modification Example of Embodiment 5.
Figure 20:
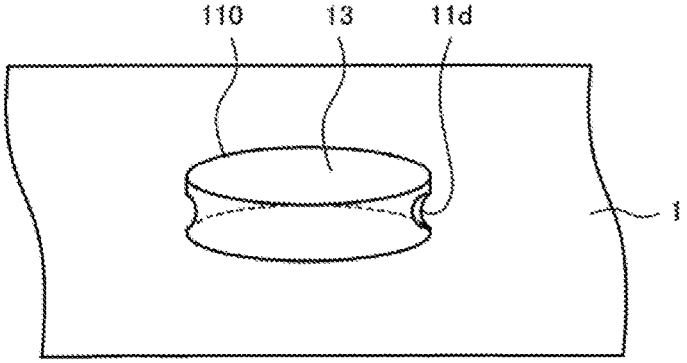
FIG. 20 is a perspective view of the fin collar of FIG. 19.

FIG. 19 is a schematic view for illustrating the fin collars 11 of the heat exchanger 10 according to Modification Example of Embodiment 5. FIG. 20 is a perspective view of the fin collar 11 of FIG. 19. FIG. 16 is a schematic view corresponding to FIG. 3 referred to in the description of Embodiment 1. As illustrated in FIG. 19 and FIG. 20, on the fin collar 11 protruding in the stacking direction at the opening 110, projecting portions 11*d* each having a semi-spherical shape and protrudes toward the interior are formed.

The projecting portions 11*d* each have, for example, a shape recessed from the outer surface, and are arranged along the flow of the fluid flowing through the liquid passage pipe 13. The two projecting portions 11*d* are arranged at positions opposite to each other. Also in Modification Example, similarly to Embodiment 5, even when the flow through the liquid passage pipe 13 is laminarized, the heat exchange performance is enhanced due to the front edge effect.

Figure 21:
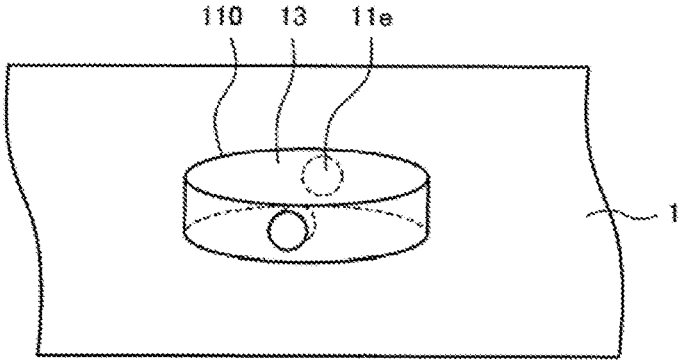
FIG. 21 is a perspective view of the fin collar formed on the fin adjacent to the fin of FIG. 20.

FIG. 21 is a perspective view of the fin collar 11 formed on the fin 1 adjacent to the fin 1 of FIG. 20. As illustrated in FIG. 21, projecting portions 11*e* are formed on the fin 1 adjacent to the fin 1 illustrated in FIG. 20, and are arranged at positions shifted by a half pitch in the circumferential direction from the projecting portions 11*d*. Also in this case, the offset fin arrangement in which the projecting portions 11*e* are shifted by a half pitch in the circumferential direction from the projecting portions 11*d* is employed. Thus, an influence of a downstream of the second fin arranged close to the upstream can be reduced, thereby further enhancing the heat transfer performance.

Embodiment 6

The heat exchanger 10 according to Embodiment 6 is different from those of Embodiments 1 to 5 in that a plurality of bent portions 11*f* are formed in the circumferential direction of each of the openings 110 as the second fin.

Figure 22:
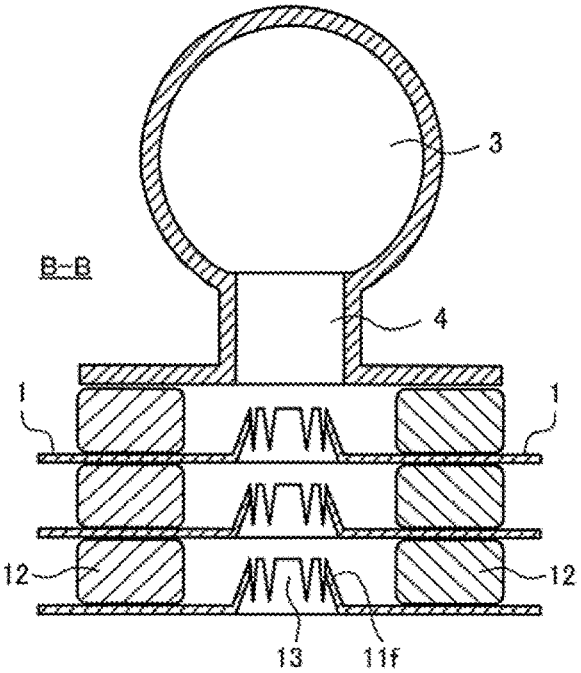
FIG. 22 is a schematic view for illustrating fin collars of the heat exchanger according to Embodiment 6.
Figure 23:
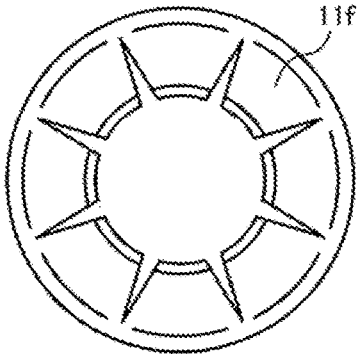
FIG. 23 is a schematic view of the fin collar of FIG. 23 as viewed in a direction of a flow through a liquid passage pipe.
Figure 24:
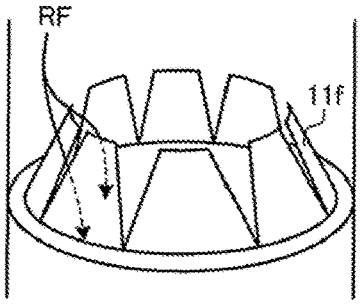
FIG. 24 is a perspective view of the fin collar of FIG. 23.

FIG. 22 is a schematic view for illustrating the fin collars 11 of the heat exchanger 10 according to Embodiment 6. FIG. 23 is a schematic view of the fin collar 11 of FIG. 23 as viewed in the direction of the flow through the liquid passage pipe 13, and FIG. 24 is a perspective view of the fin collar 11 of FIG. 23. FIG. 22 is a schematic view corresponding to FIG. 3 referred to in the description of Embodiment 1. As illustrated in FIG. 22, FIG. 23, and FIG. 24, in the heat exchanger 10 according to Embodiment 6, the fin collar 11 of each of the plurality of fins 1 includes the plurality of bent portions 11*f* formed at the opening 110. The plurality of bent portions 11*f* are bent in the same direction so that distal end portions of the plurality of bent portions 11*f* extend along the liquid passage pipe 13, and are arranged in the circumferential direction.

As described above, the bent portions 11*f* formed at positions close to the inside of the opening 110 are arranged along the flow of the fluid flowing through the liquid passage pipe 13 in such a manner that the distal end portions continue intermittently in the circumferential direction. Thus, even when the flow is laminarized, the heat exchange performance is enhanced due to the front edge effect. Further, the clearance secured in the circumferential direction is provided between the bent portions 11*f*, thereby the heat exchange performance can be enhanced while the flow resistance is reduced. In the description above, the case in which the eight bent portions 11*f* are arranged in the circumferential direction of the opening 110 is described. However, the number of the bent portions 11*f* may be two. Although the number is not limited, as the number is increased, the effect of promoting heat transfer can be enhanced.

Modification Example 1 of Embodiment 6

Figure 25:
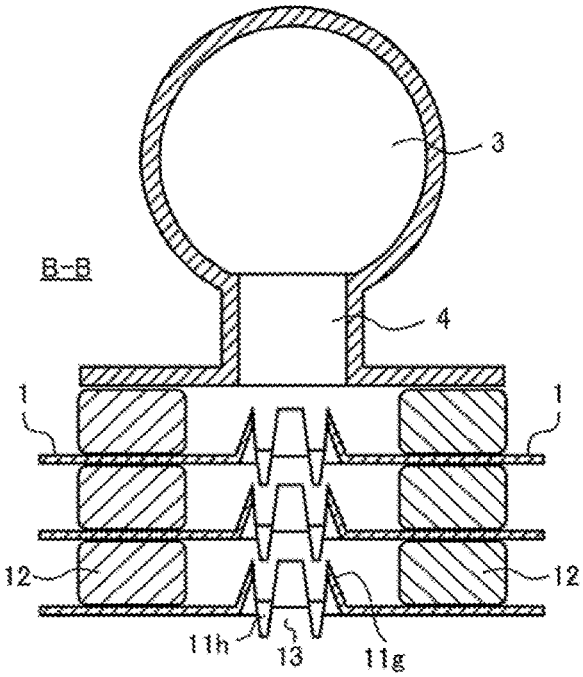
FIG. 25 is a schematic view for illustrating fin collars of the heat exchanger according to Modification Example of Embodiment 6.
Figure 26:
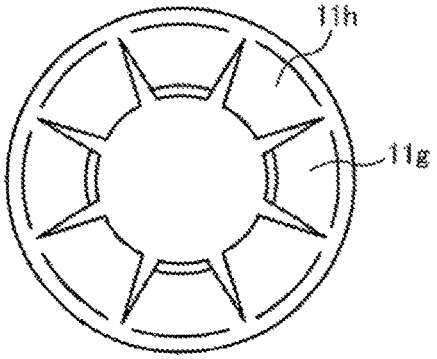
FIG. 26 is a schematic view of the fin collar of FIG. 25 as viewed in the direction of the flow through the liquid passage pipe.
Figure 27:
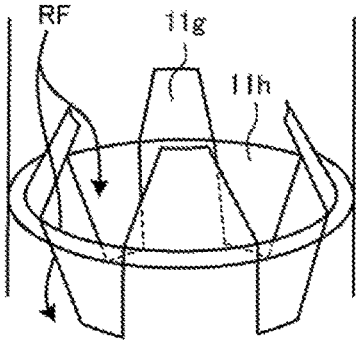
FIG. 27 is a perspective view of the fin collar of FIG. 25.

FIG. 25 is a schematic view for illustrating the fin collars 11 of the heat exchanger 10 according to Modification Example 1 of Embodiment 6. FIG. 26 is a schematic view of the fin collar 11 of FIG. 25 as viewed in the direction of the flow through the liquid passage pipe 13, and FIG. 27 is a perspective view of the fin collar 11 of FIG. 25. FIG. 22 is a schematic view corresponding to FIG. 3 referred to in the description of Embodiment 1. Further, in FIG. 25, the arrows indicate the flow of the water RF serving as heat transfer medium.

As illustrated in FIG. 25, FIG. 26, and FIG. 27, the fin collar 11 of each of the plurality of fins 1 includes a plurality of bent portions 11*g* and 11*h* formed in the circumferential direction at positions close to the inside of the opening 110. The plurality of bent portions 11*g* and 11*h* are arranged so that distal end portions of the plurality of bent portions 11*g* and 11*h* extend along the liquid passage pipe 13, and that the adjacent bent portions 11*g* and 11*h* are bent in directions reverse to each other.

As described above, when the adjacent bent portions 11*g* and 11*h* are bent in directions reverse to each other, the heat transfer medium can pass through large clearances secured between the adjacent bent portions 11*g* and 11*h* in the circumferential direction. With this configuration, in addition to the effect of Embodiment 6, an effect of further reducing the flow resistance to enhance the heat exchange performance can be attained.

Modification Example 2 of Embodiment 6

Figure 28:
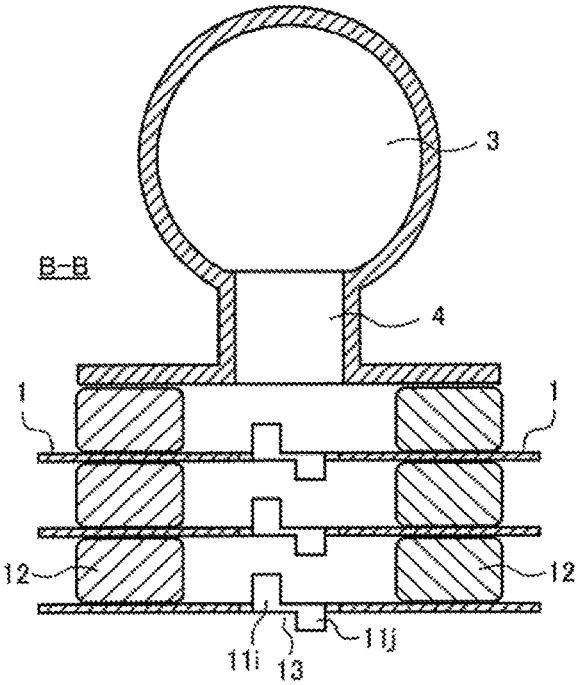
FIG. 28 is a schematic view for illustrating fin collars of the heat exchanger according to Modification Example 2 of Embodiment 6.
Figure 29:
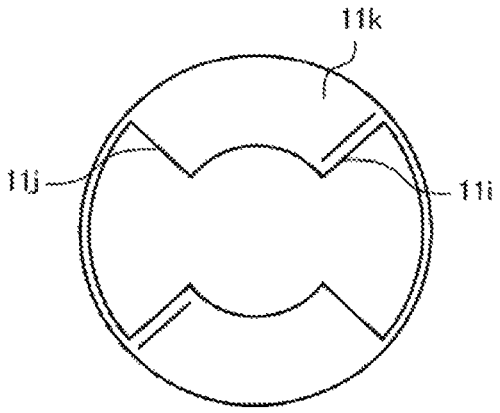
FIG. 29 is a schematic view of the fin collar of FIG. 28 as viewed in the direction of the flow through the liquid passage pipe.
Figure 30:
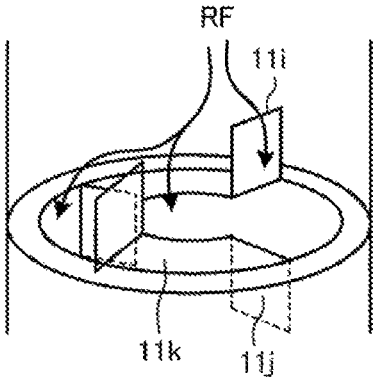
FIG. 30 is a perspective view of the fin collar of FIG. 28.

FIG. 28 is a schematic view for illustrating the fin collars 11 of the heat exchanger 10 according to Modification Example 2 of Embodiment 6. FIG. 29 is a schematic view of the fin collar 11 of FIG. 28 as viewed in the direction of the flow through the liquid passage pipe 13, and FIG. 30 is a perspective view of the fin collar 11 of FIG. 28. FIG. 22 is a schematic view corresponding to FIG. 3 referred to in the description of Embodiment 1. Further, in FIG. 25, the arrows indicate the flow of the water RF serving as heat transfer medium.

As illustrated in FIG. 28, FIG. 29, and FIG. 30, the fin collar 11 of each of the plurality of fins 1 includes a plurality of bent portions 11*i* and 11*j* and flat portions 11*k* formed in the circumferential direction at positions close to the inside of the opening 110. The plurality of bent portions 11*i* and 11*j* are formed by bending parts of the opening 110 in the circumferential direction along the flow through the liquid passage pipe 13, and the flat portions 11*k* are perpendicular to the liquid passage pipe 13.

With such a configuration, as described in Embodiment 6 and Modification Example 1 of Embodiment 6, the clearances are secured at the bent portions 11*i* and 11*j* formed by bending the parts in the circumferential direction from the flat portions 11*k* along the flow through the liquid passage pipe 13. With this configuration, the effect of reducing the flow resistance to enhance the heat exchange performance can be attained.

The distal ends of the adjacent bent portions 11*i* and 11*j* in this modification example are arranged to be bent in directions reverse to each other, but may be bent in the same direction. As the areas of the bent portions 11*i* and 11*j* are increased, heat transfer is enhanced due to the front edge effect and the flow resistance is reduced. However, the bent portions 11*i* and 11*j* are divided from the fin 1 in the radial direction, that is, the heat transfer direction. Consequently, a heat conduction loss is also increased, and thus, there are optimum areas of the bent portions 11*i* and 11*j*. In Embodiment 6 and Modification Example 1 of Embodiment 6, the bent portions 11*f*, 11*g*, and 11*h* are divided in the circumferential direction, that is, in a direction at a right angle to the heat transfer direction. Consequently, there is no effect of reducing the heat transfer by the division.

REFERENCE SIGNS LIST

1 fin 2 inlet header 3 outlet header 4 connection pipe 10 heat exchanger 11, 11*a*, 21, 31, 32 fin collar 11*b*, 11*c* protruding portion
11*d*, 11*e* projecting portion 11*f*, 11*g*, 11*h*, 11*i*, 11*j* bent portion 11*k* flat portion 12, 12*a*, 12*b*, 23*b* resin part 13 liquid passage pipe 14 fin core
21*a* flange portion 31*a* liquid passage hole 32*a* slit 41*a*, 41*b*, 41*c* protrusion 42*a*, 42*b* recessed portion 43 cut-and-raised portion 44 cutout portion 110 opening

The invention claimed is:

1. A heat exchanger, comprising:

a plurality of fins each having a flat plate shape;

openings provided in each of the plurality of fins; and cylindrical parts arranged on outer peripheries of the openings, each having an inner diameter larger than an outer diameter of each of the openings, the plurality of fins being stacked on one another with the cylindrical parts interposed between the plurality of fins, the openings and the cylindrical parts being configured to form a liquid passage pipe, the openings being inside the cylindrical parts, the plurality of fins including a second fin protruding from a respective one of the openings to a direction in which the plurality of fins are stacked on one another, the second fin being a cylindrical shape, and the second fin including a plurality of protruding portions projecting toward an interior of the cylindrical shape, wherein there is a gap through which a liquid flows between the interior of the cylindrical parts and the second fin.

2. The heat exchanger of claim 1, wherein the plurality of protruding portions each have a rectangular shape or a semispherical shape.

3. The heat exchanger of claim 1, wherein, in adjacent ones of the plurality of fins, one of the plurality of protruding portions is positioned to be shifted by a half pitch in a circumferential direction of the cylindrical shape to another one of the plurality of protruding portions.

4. The heat exchanger of claim 1, wherein each of the plurality of fins includes a projection formed on an outer periphery of each of the cylindrical parts to protrude in a direction perpendicular to one surface of a corresponding one of the plurality of fins.

5. The heat exchanger of claim 1, wherein each of the plurality of fins includes a cutout portion and a cut-and-raised portion positioned on an outer periphery of each of the cylindrical parts.

6. The heat exchanger of claim 1, wherein a layer of a material having a higher ionization tendency than that of a material of the plurality of fins is provided on a surface of each of the plurality of fins.

7. The heat exchanger of claim 1, wherein a surface of each of the plurality of fins is covered by a resin coating layer.

* * * * *